United States Patent [19]

Drugge

[11] 4,168,951

[45] Sep. 25, 1979

[54] METHOD OF SINTERING AND APPARATUS FOR CARRYING OUT THE METHOD

[75] Inventor: Roland Drugge, Malmberget, Sweden

[73] Assignee: Luossavaara-Kiirunavaara Aktiebolag, Stockholm, Sweden

[21] Appl. No.: 841,385

[22] Filed: Oct. 12, 1977

[30] Foreign Application Priority Data

Oct. 15, 1976 [SE] Sweden ..... 76114776
Nov. 16, 1976 [SE] Sweden ..... 76127935

[51] Int. Cl.[2] ..... F27B 15/00; F27B 7/02

[52] U.S. Cl. ..... 432/13; 432/14; 432/22; 432/106; 432/144

[58] Field of Search ..... 432/13, 14, 15, 106, 432/144, 145, 22; 266/145, 155, 156

[56] References Cited

U.S. PATENT DOCUMENTS

| | | | |
|---|---|---|---|
| 3,088,732 | 5/1963 | Haley et al. | 266/155 |
| 3,172,754 | 3/1965 | Anthes et al. | 266/156 |
| 3,203,782 | 8/1965 | Meyer et al. | 75/5 |
| 3,245,778 | 4/1966 | Ban | 75/5 |
| 3,264,091 | 8/1966 | Ban | 75/5 |
| 3,527,448 | 9/1970 | Ghiea | 266/156 |
| 3,661,553 | 5/1972 | Fraus | 266/155 |
| 3,671,027 | 6/1972 | Fraus | 432/14 |
| 3,801,267 | 4/1974 | Okuno et al. | 266/156 |
| 3,986,819 | 10/1976 | Heian | 432/14 |

FOREIGN PATENT DOCUMENTS

| | | | |
|---|---|---|---|
| 1483582 | 6/1966 | France | 432/266 |
| 2297922 | 1/1975 | France | 432/266 |

*Primary Examiner*—John J. Camby
*Attorney, Agent, or Firm*—Fleit & Jacobson

[57] ABSTRACT

Agglomerates are fired in a sintering apparatus of the type, in which the agglomerates during transport on a travelling grate in zones along said grate are pre-dried with substantially pure warm air passing upwardly through the grate and finally dried and heated with hot process gas passing downwardly through the grate, and in which the hot process gas is generated by combusting fuel while using, as secondary air of combustion, air previously used to cool fired agglomerates. In order to reduce the quantity of gas contaminated during the firing process there is maintained in a sealing zone located between the pre-drying and final-drying zones and mechanically shielded thereagainst, by supplying air above the grate and removing air by suction from beneath the grate, pressures which are substantially equal to the pressure above the grate and the pressure beneath the grate respectively in the adjacent final-drying zone.

22 Claims, 2 Drawing Figures

Figure 1:
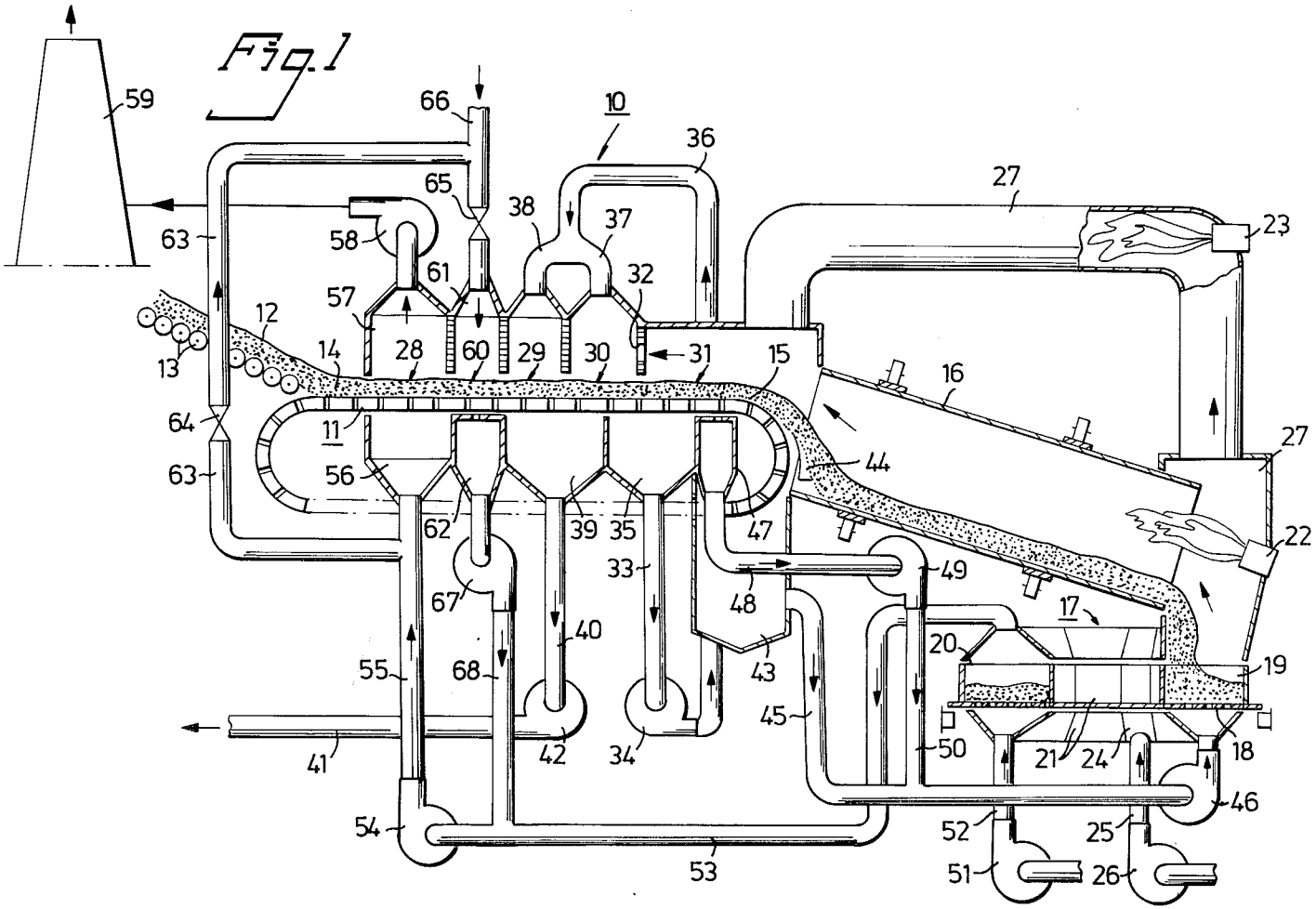

110
111
112
113
114
115
116
117
118
119
120
121
122
123
124
125
126
127
128
129
130
131
132
133
134
135
136
137
138
139
140
141
142
143
144
145
146
147
148
149
150
151
152
153
154

METHOD OF SINTERING AND APPARATUS FOR CARRYING OUT THE METHOD

The present invention relates to a method of continuously firing agglomerated material, in particular to pellet sintering, while using an apparatus which is shielded against the surrounding atmosphere and in which the agglomerates during transport on at least one movable grate in zones arranged along said grate are pre-dried with pure air passing upwardly through the grate and finally dried and heated with hot process gas passing downwardly through the grate, said hot process gas being generated by combusting fuel whilst using as secondary air of combustion, cooling air previously used in a cooling section for cooling the fired agglomerates. The invention also relates to an apparatus for carrying out the method.

Because of the rigorous requirements concerning the purification of exhaust gases, methods and apparatus of the type described present serious problems owing to the large quantities of gas which are contaminated by the combustion of fuel in the conventional operation of such apparatus, and by the formation of volatile impurities when the agglomerates are fired. Air leaking into the apparatus and gas leaking between the individual zones of the apparatus cause the quantity of contaminated gas to greatly increase and result in the dilution of the impurities in the departing gas, thereby rendering purification of the gas more difficult and requiring the provision of large and expensive gas-purification apparatus.

For the purpose of at least substantially eliminating the aforementioned problems, there is proposed in accordance with the invention a method of the aforementioned type in which there is maintained in a sealing zone located between the pre-drying and the final-drying zones and mechanically shielded thereagainst by supplying air above the grate and removing air by suction from beneath said grate, pressures which are substantially equal to the pressure above the grate and the pressure beneath the grate respectively in the adjacent final-drying zone. In this way the most troublesome impurities, such as $SO_2$, HCl and HF are concentrated to a relatively small quantity of gas, normally in the order of magnitude of approximately 60% of the total gas quantity, thereby reducing the investment costs for required gas-purification apparatus whilst improving the efficiency of the gas-purification apparatus as a result of the higher percentages of impurities in the gas to be purified. The pure air used for pre-drying purposes, which air can conveniently comprise air previously used for finally cooling the agglomerates in the cooling section when the cooling section exhibits separate primary and secondary cooling zones, remains so clean that it can be released to the surroundings without first being purified. In this respect, the primary and secondary cooling zones of the cooling section are suitably mutually separated by means of gas-sealing zones enclosing the primary cooling zone, these sealing zones being supplied with pure air at a pressure substantially the same as the pressure prevailing in the primary cooling zone. The air used for the latter sealing purposes, which air may have become contaminated by cooling gas used in the primary cooling zone, may conveniently be used as further secondary air of combustion for the manufacture of process gas.

The pressure in the part of the sealing zone located above the grate between the pre-cooling and final-cooling zones is conveniently generated by supplying air previously used for finally cooling the agglomerates in the cooling section. By adjusting the pressure of this air, gas is prevented from leaking from the part of the final-drying zone located above the grate. The major part of the sealing air which does not pass through the gate to the underlying part of the sealing zone leaks out in the part of the pre-drying zone located above the bed.

The air removed by suction from the part of the sealing zone located beneath the grate is suitably charged to the pre-drying air so as not to dilute the gas used in the final-drying zone. By adjusting the pressure in this part of the sealing zone, contaminated gas is prevented from leaking in from the final-drying zone, whilst air leaking from the part of the pre-drying zone located beneath the grate and having a higher pressure will not cause any contamination of the pre-drying air or dilution of the final-drying gas.

When the method is carried out in an apparatus of the type comprising at least one movable grate, a rotary kiln connected to the outfeed end of the grate, and a cooling section connected to the outfeed end of the rotary kiln, it is proposed in accordance with a further embodiment of the invention, in order to prevent process gas being diluted at the transition between the grate and the rotary kiln, to maintain in a further sealing zone arranged beneath the grate adjacent the outfeed end thereof and mechanically shielded against the undersurface of the grate by removing gas by suction a pressure which is substantially equal to the pressure in the part of the adjacent heating zone located beneath the grate. Corresponding advantages can be gained when the method is carried out in an apparatus, in which the agglomerates are cooled on the grate with cooling air passing upwardly through said grate, by maintaining in a further sealing zone arranged beneath the grate immediately upstream of the cooling section operating with upwardly flowing air and mechanically shielded against the underside of the grate by removing gas by suction a pressure which is essentially equal to the pressure in the part of the adjacent heating zone located beneath the grate. The gas withdrawn by suction from said further sealing zone can be conveniently passed to the cooling section.

With conventional methods and apparatus of the type defined in the introduction, the process gas intended for heating the agglomerates is drawn in the heating zones through the bed of material and the grate by means of two or more suction chambers arranged beneath the grate, desired subpressure being maintained in the suction chambers by means of suction fans connected thereto. In the latter stage of the heating operation, however, the temperature of the process gas utilized for heating purposes and departing from the underside of the grate is of such high magnitude that it has been necessary to mix this gas with a cooling gas before said gas reaches the suction fan of the last suction chamber in line, in order to protect said fan. This lastmentioned suction fan must therefore be dimensioned so that its capacity is sufficient for it to handle both the process gas and the cooling gas, with resulting large costs for its manufacture and operation. Furthermore, the devices required for supplying the cooling gas to and mixing the cooling gas with the hot process gas increase investment and operational costs. For avoiding this disadvantage it is proposed in accordance with the invention to cool the gas used for the latter part of the heating operation by indirect heat exchange and then to use said gas as final-drying gas. Provided that the energy obtained with this heat exchange is recovered, it is possible in this way to save, without incurring any substantial additional investment costs, energy in the order of magnitude of 5–10% of the total amount of energy required for the firing process, i.e. the energy represented by the fuel for generating combustion gases and the electrical power required for operating the fans by which the desired gas flows are maintained. The aforementioned indirect heat-exchange is conveniently carried out in a steam boiler, whereby the energy recovered is obtained in a readily usable form.

The present invention also relates to an apparatus for carrying out the aforedescribed method, which apparatus is shielded against the surrounding atmosphere and is of the type comprising at least one movable grate on which the agglomerates during transport through the apparatus in sequentially arranged zones are pre-dried with pure air passing upwardly through the grate and finally dried and heated with hot process gas passing downwardly through the grate, and cooled with cooling air passing upwardly through the grate, the apparatus being provided with means for conducting air previously used in a cooling section for cooling the fired agglomerates as secondary air to at least one burner for generating hot process gas required for the firing process, the apparatus being characterized mainly by the fact that it includes a sealing zone arranged between the pre-drying and the final-drying zones and mechanically shielded thereagainst, to which sealing zone there are connected means for controlled supply of air above the grate and controlled withdrawal of air by suction beneath the grate in such a manner that there is maintained in said zone pressures which are substantially equal to the pressure above the grate and beneath the grate respectively in the adjacent final-drying zone.

Figure 2:
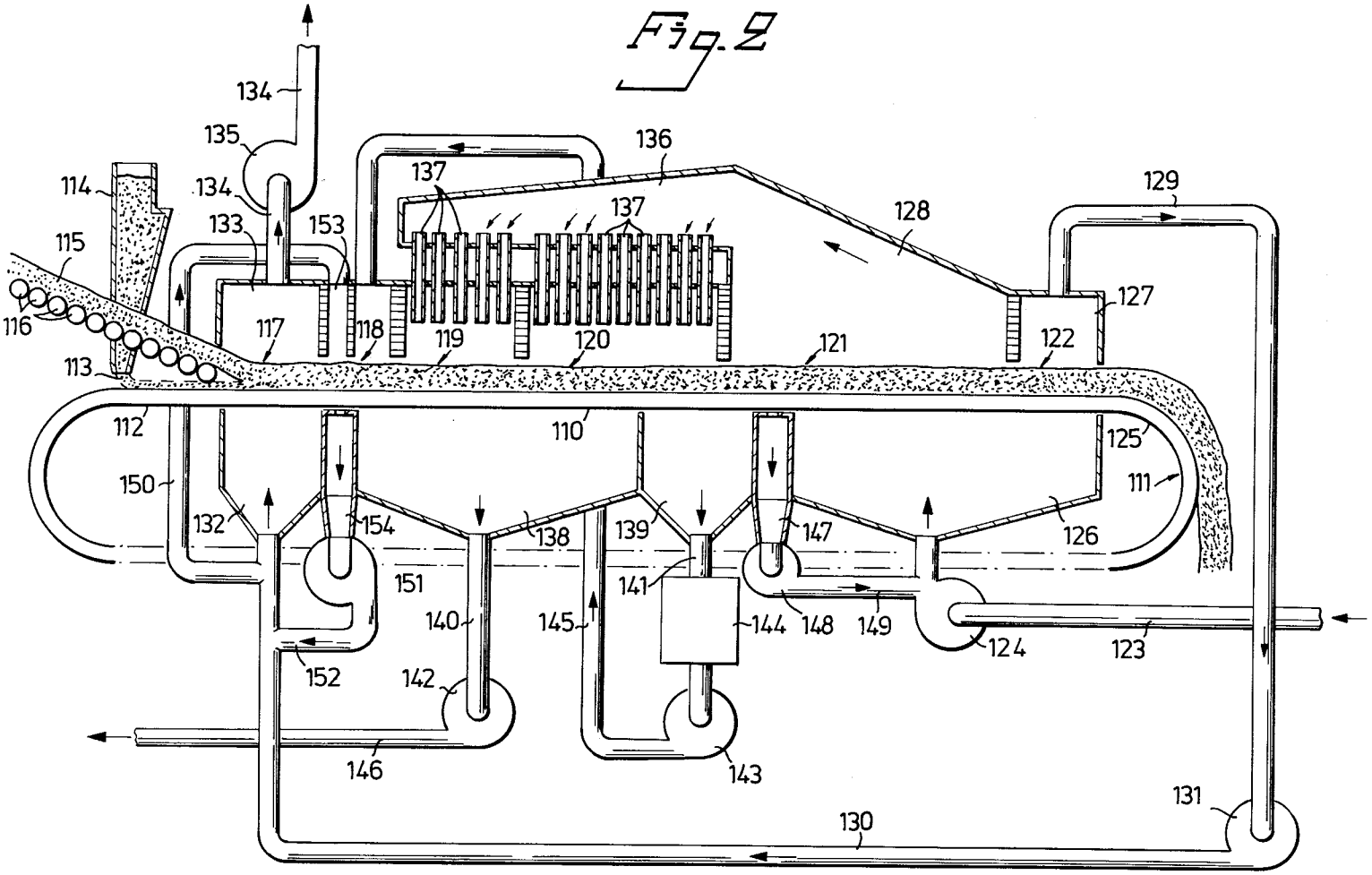

The invention will now be described in more detail with reference to the accompanying drawings, additional features of the invention being made apparent in conjunction therewith. In the drawings:

FIG. 1 illustrates schematically a first embodiment of a firing apparatus according to the invention; and FIG. 2 illustrates schematically a second embodiment of a firing apparatus according to the invention.

The apparatus illustrated in FIG. 1 comprises a grate section 10 shielded against the surrounding atmosphere and having a movable grate 11 formed by the upper horizontal part of an endless gas-permeable grate belt. To the grate 11 there is charged an agglomerated material 12 in the form of moist, green pellets formed by a pellet rolling operation, which pellets are to be fired in the apparatus. The pellets are fed to the infeed part 14 of the grate 11 by means of a conveyor 13, and are dried and heated during their passage through the grate section 10 and are discharged at the outfeed part 15 of the grate 11 to an inclined rotary kiln 16, from the lower end of which the pellets are discharged to a cooling section formed by a separate cooler 17. The cooler 17, the rotary kiln 16 and the grate section 10 are shielded against the surrounding atmosphere and a pressure beneath atmospheric pressure is maintained in the apparatus as a whole.

In the illustrated example, the cooler 17 is provided with a ring-shaped movable, gas-permeable grate 18 and is divided by means of shields (not shown) into a primary cooling zone 19, into which the pellets discharged from the rotary kiln 16 are passed and pre-cooled during transport on the grate 18 to a secondary cooling zone 20 in which the pellets are finally cooled by means of pure air. The pellets are transported from the secondary cooling zone 20 on the grate 18 to a discharge zone 21, from which the fired and cooled pellets are removed in a suitable manner (not shown). Pre-cooling of the pellets is effected with relatively hot air, which is drawn in at the transition region between the grate section 10 and the rotary kiln 16 and which may be contaminated by volatile impurities fumed off from the pellets and by process gas intended for the firing process, which process gas is generated by combusting fuel in the apparatus by means of a burner arrangement formed by burners 22, 23, said burners using primary cooling air previously used in the cooler 17 as secondary air of combustion. For reasons of clarity, the fuel inlet lines and the primary air lines of the burners 22, 23 have not been shown in the drawing. The primary cooling air and the secondary cooling air are passed to the underside of the cooler grate 18 and passed up through the grate and the bed of pellets resting thereon. To prevent primary cooling air from leaking from the primary cooling zone 19 to the secondary cooling zone 20, these zones of the cooler are separated by means of gas-sealing zones which embrace the primary cooling zone, of which gas-sealing zones one has been shown at 24 and to which air having the same pressure as that in the primary cooling zone is fed by means of a line 25 and a fan 26, means in the form of shielding walls or the like (not shown) being provided to guide the air used for sealing purposes in the cooler 17 to the burner arrangment 22, 23 for use therein as further secondary air of combustion.

The combustion or process gas generated by the burners 22, 23 is passed to the grate section 10 where said gas for finally drying, heating and firing the pellets is passed through the grate 11 and the bed of pellets carried thereon in the manner hereinafter described. The temperature of the pellets is equilized in the rotary kiln 16, in which the pellets are also optionally finally fired. Only a relatively small part of the total amount of combustion gas required for the firing operation is required herefore. In order to permit a rotary kiln of relatively small diameter to be used, there is provided a duct arrangement 27 which opens out at the outfeed end 15 of the grate 11 and in which at least part of the requisite process or combustion gas is generated by means of the burner 23 arranged therein. The burner 23 is arranged to use as secondary air of combustion contaminated air arriving from the primary cooling zone 19 and the burner may be arranged to generate the major part of the process gas required for the firing process and also to produce process gas at a temperature which is higher than the temperature of the pellets present in the rotary kiln. When the pellets contain impurities such as alkali impurities or other impurities which become volatile at high temperatures, these impurities can be caused to volatilize first in the rotary kiln 16 by suitable adjustment of the temperature of the agglomerates in the grate section and of the agglomerates in the rotary kiln 16. Means are then provided (not shown) for separating the gases leaving the rotary kiln 16. These separated gases are suitably passed to means for purifying said gases with respect to said volatile impurities. This purifying means may comprise a cooler in which the impurities are condensed by cooling the separated gases, wherewith means may be provided for conducting the thus cleansed gases to the grate section 10.

The grate section 10 comprises a plurality of drying and heating zones arranged along the grate 11 and shielded from each other, said zones comprising a pre-drying zone 28 and a final-drying zone 29 in which the pellets are pre-dried by means of pure hot air passing upwardly through the grate 11 and finally dried by means of hot process gas which has previously been used for heating or firing the pellets and which passes downwardly through the grate and the layer of agglomerates thereon, and a pre-heating zone 30 and a final-heating zone 31 in which the pellets are pre-heated and finally heated respectively and more or less finally fired by means of hot process gas passing downwardly through the grate 11. Process gas is passed to the zone 31 from the duct arrangement 27 and the rotary kiln 16, while unused process gas is passed to the pre-heating zone 30 through openings 32 in the shield located above the grate 11 between the zones 30 and 31 together with previously used process which is removed by suction, by means of a line 33 and a fan 34, through a suction chamber 35 located immediately beneath a part of each of the zones 30 and 31 and passed through a line 36 and a branch line 37 to the zone 30. Process gas collected in the suction chamber 35 is also passed to the final-drying zone 29 through a further branch line 38. Arranged immediately beneath the final-drying zone 29 and a part of the pre-heating zone 30 is a second suction chamber 39 from which the process gas is finally passed, via lines 40, 41 and a fan 42, to a gas-purifying apparatus (not shown). Beneath the outfeed end of the grate 11 and the transition region between the grate 11 and the rotary kiln 16 there is arranged a collecting vessel 43 which collects those pellets which a scraping device 44 arranged adjacent the outfeed end 15 of the grate 11 has been unable to feed the rotary kiln, said vessel being connected to the suction side of the fan 46 via a line 45. Thus, a subpressure prevails in the collecting vessel 43, such that air leaking in between the grate section 10 and the rotary kiln passes into said vessel together with process gas which passes through the outfeed part of the grate 11 and leaks from the infeed part of the rotary kiln. The gas collected in the vessel 43 is passed to the cooler 17, via the line 45 and fan 46, for primary cooling of the ready-fired pellets leaving the rotary kiln 16, and is then passed, as before-described, to the rotary kiln 16 and the duct arrangement 27, where said gas is used as secondary air of combustion for the burner arrangement 22, 23.

To prevent the process gas collected in the suction chamber 35 from being diluted with air leaking from the transition zone between the grate section 10 and the rotary kiln 16, there is arranged beneath the grate 11, between the chamber 35 and the outfeed end of the grate 11, a sealing zone which is formed by a chamber 47 located adjacent the undersurface of the grate, said chamber 47 communicating with the grate 11 via one or more relatively small openings (in the illustrated example a narrow slot), whilst being mechanically shielded against the undersurface of the grate in other respects by means of horizontal plates, as indicated in the drawing. The chamber 47 is connected to the suction side of a fan 49 by means of a line 48, wherewith gas is withdrawn from the chamber 47 by suction in a manner so controlled that there is maintained in said chamber a pressure which is substantially equal to the pressure in the part 35 of the adjacent final-heating zone 31 located beneath the grate 11. The gas removed from the chamber 47 by suction is fed, via a line 50 from the fan 49 to the line 45 and from thence to the primary cooling zone 19 of the cooler 17.

The pure air intended for finally cooling the pellets in the secondary cooling zone 20 of the cooler 17 is passed to the cooler beneath the cooling gate 18 by means of a fan 51 and a line 52. The air used to finally cool the pellets is removed by suction, via a line 53, to a fan 54 whose pressure side is connected, via a line 55, to a pressure chamber 56 located beneath the grate and associated with the pre-drying zone 28, from which pressure chamber the pre-drying air is forced up through the grate and the green pellets carried thereon to a collecting chamber 57, from which the air used to pre-dry the pellets is passed, via a fan 58, to the chimney 59 to be released to atmosphere.

Arranged between the pre-drying and final-drying zones 28,29 is a sealing zone 60 which is mechanically shielded thereagainst and to which there is connected means for controlled supply of air above the grate 11 and controlled removal of air by suction from beneath the grate 11 in such a manner that there is maintained in said zone pressures which are substantially equal to the pressure above said grate and the pressure beneath said grate respectively in the adjacent final-drying zone 29. The sealing zone 60 comprises a pressure chamber 61 located above the grate 11 and a suction chamber 62 located beneath said grate.

As illustrated in the drawing, there is connected to the pressure chamber 61 a line 63 which branches from the line 55, the line 63 being operative to conduct air used to finally cool the pellets in the cooler 17 to the part of the sealing zone 60 located above the grate, said line 63 being provided with valve means 64, 65 for adjusting the pressure of the chamber 61 to the desired magnitude. Alternatively, as indicated at 66, the chamber 61 may be connected to the surrounding atmosphere, the valve 64 then being held closed and the pressure in the chamber 61 being adjusted solely by means of the valve 65. This is possible when the whole of the apparatus operates at a pressure beneath atmospheric pressure, which is normally the case. The suction chamber 62 is substantially of the same construction as the aforedescribed chamber 47, the desired subpressure in the chamber 62 being maintained by means of a suction fan 67 connected thereto, the pressure side of which suction fan passes the air removed by suction from the chamber 62, via a line 68, to the pre-drying air flowing through the line 53.

The apparatus illustrated in FIG. 2 comprises a movable grate 110 which is shielded against the surrounding atmosphere and which is formed by the upper horizontal part of an endless gas-permeable grate belt 111. Supplied to the infeed part 112 of the grate 110 is a relatively thin bottom layer of mechanically strong agglomerates 113 taken from a bin 114, and a relatively thick upper layer of agglomerated material 115 in the form of moist green pellets or raw pellets formed by pellet rolling, which pellets are to be fired in the apparatus, the green pellets being charged by means of a conveyor 116. The grate transports in the bed of pellets formed by the layers of agglomerates through pre-drying and final-drying zones 117, 118, pre-heating and final-heating zones 119, 120 and pre-cooling and final-cooling zones 121, 122. In the pre-drying zone 117 and in the cooling zones 121, 122 the green pellets are pre-dried and the pellet bed is cooled respectively by means of a gas passing upwardly through the grate 110 and the bed of pellets, whilst the pellet bed for the purpose of firing the green pellets is pre-heated in the zone 119 and finally heated in the zone 120 by means of process gas passing downwardly through the pellet bed and the grate. As cooling gas there is used air charged, via a line 123 and a fan 124, to a pressure chamber 126 located beneath the grate 110 adjacent the outfeed end 125 thereof. On the side of the grate opposite the pressure chamber 126 there are arranged collecting chambers 127, 128 which are mutually separated by a suspended wall and serve to collect the cooling air. The warm, but relatively pure air used for the final-cooling operation is used also as a pre-drying gas and is passed via lines 129, 130, by means of a fan 131, to a pressure chamber 132 located beneath the pre-drying zone 117, from which chamber said air is passed through the grate 110 and the pellet bed to a collecting chamber 133. The air used for pre-drying is withdrawn from the collecting chamber 133 by suction and passed to a chimney (not shown) by means of a fan 135 via lines 134.

The air used for pre-cooling departs through a main duct 136 and distribution lines 137 to the pre-heating and final-heating zones 119, 120, where it is used as secondary air for burners (not shown), which burners are arranged above the pellet bed and generate hot process gas intended for the pre-heating and final-heating operations. Above the grate 110 the pre-heating and final-heating zones 119, 120 are separated from each other and from the final-drying and pre-cooling zones 118, 121 by means of suspended walls. Arranged beneath the grate 110 between the pressure chambers 126 and 132 are suction chambers 138 and 139 which are connected to the suction side of respective fans 142, 143 via lines 140, 141 respectively.

Upstream of the fan 143 there is connected a device 144, preferably having the form of a stream boiler, in which the hot gases arriving from the suction chamber 139 are cooled by indirect heat exchange before they reach the fan 143. The hot gases are cooled to a temperature suitable for drying purposes, for example to a temperature of approximately 350° C., and are passed from the fan 143 to the final-drying zone 118 via a line 145. The gases collected in the suction chamber 138 are passed from the fan 142 to a gas-purifying plant (not shown) via a line 146.

To prevent the contaminated gas collected in the suction chamber 139 from being diluted with air leaking from the pressure chamber 126 there is arranged beneath the grate 110, between the chambers 139 and 126, a sealing zone formed by a chamber 147 located adjacent the undersurface of the grate, which chamber communicates with the grate 110 through one or more relatively small openings (in the illustrated embodiment a narrow slot) and is mechanically shielded against the underside of the grate in other respects by means of horizontal plates, as indicated in the drawing. The chamber 147 is connected to the suction side of a fan 148, by means of which gas is removed from the chamber 147 by suction in a manner so controlled that there is maintained in the chamber a pressure which is substantially equal to the pressure in the part 139 of the adjacent final-heating zone 120 located beneath the grate 110. The gas removed from the chamber 147 is conveyed from the fan 148, via a line 149, to the pressure side of fan 124, from whence said gas is passed to the pressure chamber 126.

Arranged between the pre-drying and final-drying zones 117, 118 and mechanically shielded thereagainst is a sealing zone to which means 150, 151, 152 are connected for controlled supply and withdrawal of air above and beneath the grate 110 respectively in a manner such as to maintain pressures which are substantially equal to the pressure above the grate and the pressure beneath the grate respectively in the adjacent final-drying zone 118. The sealing zone comprises a pressure chamber 153 located above the grate 110 and a suction chamber 154 located beneath the grate 110.

As illustrated there is connected to the pressure chamber 153 a line 150 which branches from the line 130 and which serves to conduct part of the air previously used for finally cooling the pellets in zone 122 to the part 153 of the sealing zone located above the grate. The suction chamber 154 is constructed substantially in the same manner as the aforedescribed chamber 147, the desired subpressure being maintained in the chamber 154 by means of a suction fan 151 connected thereto, the pressure side of which fan, via a line 152, supplies the air removed from the chamber 154 to the pre-drying air flowing through the line 130.

Since the system required for controlling the different fans in a manner to maintain the air-flow patterns aforedescribed and indicated by the arrows in the drawings does not form any part of the invention, no such system has been shown or described.

The invention is not restricted to the described and illustrated embodiments but can be modified within the scope of the accompanying claims.

I claim:

1. A method of continuously firing agglomerated material and agglomerates, particularly pellet sintering, the method using an apparatus having a housing which is shielded from the surrounding atmosphere, at least one movable grate for transporting agglomerated material through the housing, means within the housing for defining a plurality of drying zones and for defining a cooling section, and means for sealing the plurality of drying zones from each other, said method comprising:

transporting agglomerated material through said apparatus on the movable grate;

pre-drying the agglomerated material in a first of said plurality of drying zones with substantially pure air passing upwardly through the grate;

combustion fuel, using secondary air of combustion, to generate a hot process gas;

finally drying the agglomerated material in a last of the plurality of drying zones by passing the hot process gas downwardly through the grate;

establishing a sealing zone between the first and the last of the plurality of drying zones by supplying air above the grate and by removing, by suction, air from beneath the grate, the pressures within the sealing zone being substantially equal to the pressures in the last drying zone; and passing cooling air through the agglomerated material in the cooling section to cool the finally dried agglomerated material, the cooling air, after passing through the cooling section being used as secondary air of combustion while combusting fuel.

2. A method according to claim 1, wherein the cooling section of the apparatus has initial and final cooling sections and wherein the method further comprises passing air previously used for finally cooling the agglomerates in the cooling section through agglomerated material in the first of the plurality of drying zones.

3. A method according to claim 1, wherein the cooling section of the apparatus has initial and final cooling sections and wherein the method further comprises supplying air used for finally cooling the agglomerates in the cooling section to the part of the sealing zone located above the grate to generate the required pressure.

4. A method according to claim 1 further comprising supplying air removed by suction from the part of the sealing zone located beneath the grate to the first of the plurality of drying zones for use as pre-drying air.

5. A method according to claim 1, wherein the method is carried out in an apparatus of the type comprising at least one movable grate, a rotary kiln connected to the outfeed end of the grate, and a cooling section connected to the outfeed end of the rotary kiln, the method further comprising maintaining, in a further sealing zone located beneath the grate adjacent the outfeed end thereof and mechanically shielded against the undersurface of the grate, by removing gas by suction, a pressure which is substantially equal to the pressure in the part of the adjacent heating zone located beneath the grate.

6. A method according to claim 5 further comprising passing gas removed by suction from the further sealing zone to the cooling section.

7. A method according to claim 5, wherein the cooling section of the apparatus includes primary and secondary cooling zones, and wherein the method further comprises establishing gas-sealing zones which embrace the primary cooling zone to separate the cooling zones from each other, the gas-sealing zones being established by supplying pure air of substantially the same pressure as that in the primary cooling zone; and utilizing the air used in the gas-sealing zones as additional secondary air of combustion in the manufacture of process gas.

8. A method according to claim 1, wherein the method is carried out in an apparatus of the type, in which the agglomerates are cooled on the grate with cooling air passing upwardly through said grate, and wherein the method further comprises maintaining, in a further sealing zone arranged beneath the grate immediately upstream of the cooling section and mechanically shielded against the underside of the grate, by removing gas by suction, a pressure which is substantially equal to the pressure in the part of the adjacent heating zone located beneath the grate.

9. A method according to claim 8 further comprising passing gas removed by suction from the further sealing zone to the cooling section.

10. A method according to claim 1 further comprising using indirect heat exchange to cool gas used for a later stage of the heating operation and using the cooled gas in the last of the drying zones as a final-drying gas.

11. A method according to claim 10, using a steam boiler to carry out the indirect heat exchange.

12. An apparatus for continuously firing agglomerates and agglomerated material, particularly pellet sintering, said apparatus comprising a housing; means for shielding the housing from the surrounding atmosphere; at least one movable grate for receiving agglomerated material and for transporting material through the housing; a plurality of sequentially arranged zones disposed within the housing for drying the material, a first of the drying zones being adapted to use substantially pure air passing upwardly through the grate to pre-dry the material, a last of the drying zones being adapted to use a hot process gas passing downwardly through the grate to finally dry and heat the material; a cooling section using cooling air for cooling the fired agglomerates; at least one burner for generating hot process gas required for a firing process; means for conducting air used as cooling air to the burner for use as secondary air; and means for forming a sealing zone between the pre-drying and final-drying zones that is mechanically shielded thereagainst, said sealing zone having means connected thereto for controlled supply of air above the grate and controlled removal of air by suction from beneath the grate in such a manner that there is maintained in said sealing zone, pressures which are substantially equal to the pressure above the grate and the pressure beneath the grate, respectively, in the adjacent final-drying zone.

13. An apparatus according to claim 12, wherein said cooling section includes an initial and a final cooling section, and wherein the apparatus further comprises means for passing air previously used to finally cool the agglomerates in the final cooling section to the pre-drying zone for use as pre-drying air.

14. An apparatus according to claim 12, wherein said means for supplying air to the part of the sealing zone located above the grate comprise a line for supplying air previously used to finally cool the agglomerates in the cooling section to said sealing zone part.

15. An apparatus according to claim 12, further comprising means for supplying the air removed by suction from the part of the sealing zone located beneath the grate to the pre-drying zone.

16. An apparatus according to claim 12, further comprising a rotary kiln connected to the outfeed end of the movable grate, the cooling section being connected to the outfeed end of the rotary kiln and operating with cooling air; a further sealing zone being located beneath the grate adjacent the outfeed end thereof and being mechanically shielded against the undersurface of the grate; and means connected to said further sealing zone for controlled removal of gas therefrom by suction in a manner such that there is maintained in said further sealing zone a pressure which is substantially equal to the pressure in the part of the adjacent heating zone located beneath the grate.

17. An apparatus according to claim 12, wherein said cooling section comprises means for cooling agglomerates on the grate with cooling air passing upwardly through said grate, and wherein said apparatus further comprises a further sealing zone arranged beneath the grate immediately upstream of the cooling section and mechanically shielded against the undersurface of the grate; and means connected to said further sealing zone for controlled removal of gas therefrom by suction in such a manner that there is maintained in said further sealing zone a pressure which is substantially equal to the pressure in the part of the adjacent heating zone located beneath the grate.

18. An apparatus according to claim 17, further comprising ducting means for conducting the gas removed from the further sealing zone by suction to the cooling section.

19. An apparatus according to claim 16, further comprising ducting means for conducting the gas removed from the further sealing zone by suction to the cooling section.

20. An apparatus according to claim 16, wherein the cooling section has primary and secondary cooling zones, the apparatus further comprising sealing means for mutually separating the cooling zones, said means comprising gas-sealing zones which embrace the primary-cooling zone and which are arranged to be supplied with pure air of the same pressure as that prevailing in the primary cooling zone, and means for conducting the air used for sealing purpose to the burner for use as additional secondary air of combustion.

21. An apparatus according to claim 12, further comprising means for cooling the gas used in a later stage of the heating operation by indirect heat exchange, and means for subsequently passing the cooled gas as drying gas to the final-drying zone.

22. An apparatus according to claim 21, wherein said means for cooling is a steam boiler.

* * * * *